United States Patent [19]

Reis

[11] 4,267,413

[45] May 12, 1981

[54] TEMPERATURE COMPENSATED PRESSURE CONTROL

[75] Inventor: Robert D. Reis, Hingham, Mass.

[73] Assignee: United Electric Controls Company, Watertown, Mass.

[21] Appl. No.: 941,276

[22] Filed: Sep. 11, 1978

[51] Int. Cl.[3] ..... H01H 35/34

[52] U.S. Cl. ..... 200/81.4; 200/834; 337/307

[58] Field of Search ..... 337/307, 308, 320, 321, 337/326; 200/83 A, 83 R, 83 C, 83 D, 83 Y, 81 R, 81.4, 81.5

[56] References Cited

U.S. PATENT DOCUMENTS

| | | | |
|---|---|---|---|
| 2,752,457 | 6/1956 | Matthews | 337/307 |
| 3,046,369 | 7/1962 | Hicks | 200/83 C |
| 3,363,072 | 1/1968 | Moody | 200/83 A |
| 3,882,439 | 5/1975 | Wolfe | 337/321 |
| 4,057,699 | 11/1977 | Reis | 200/83 D |

*Primary Examiner*—Gerald P. Tolin

*Attorney, Agent, or Firm*—Robert T. Gammons

[57] ABSTRACT

A temperature compensated pressure control device comprising switch means for supplying pressure to a pressurized zone to maintain a predetermined pressure therein, a first diaphragm responsive to depletion of the pressure in said pressurized zone to effect actuation of the switch means to supply the required pressure, a second diaphragm operable to predispose the first diaphragm for a change in temperature in said pressurized zone and sensing means for transmitting the change in temperature to said second diaphragm.

6 Claims, 7 Drawing Figures

TEMPERATURE COMPENSATED PRESSURE CONTROL

BACKGROUND OF INVENTION

In my U.S. Pat. No. 4,057,699 there is disclosed a control device for maintaining a predetermined pressure in pressurized conductors provided with temperature condensation in which SF6 is used in the pressurized chamber. In that application, there are opposed bellows responsive, respectively, to pressure in the pressurized chamber and switch means operable thereby to supply sufficient pressure to the pressurized chamber to compensate for a loss of pressure therein, and to a rise in temperature in the pressurized chamber to predispose the pressure-responsive bellows for a change in temperature in the pressurized chamber. The device of the invention operates in the same way using nitrogen in the pressurized chamber, employing diaphragms in place of a bellows structure such that it can be operated at both low and high pressure ranges and its construction and operation is vastly simplified and it sensitivity improved, thus reducing manufacturing costs, repair and adjustment.

SUMMARY OF INVENTION

A temperature compensated pressure control device comprising a first diaphragm displaceable by a loss of pressure in a pressurized zone, a second diaphragm displaceable by a change in temperature within said pressurized zone, a transmitter situated between the diaphragms with its ends in positions to be displaced in opposite directions by the displacement of the diaphragms, spring means supporting the transmitter in a predetermined position for a predetermined pressure and temperature in said pressurized zone, means connected to the pressurized zone responsive to a change in temperature in the pressurized zone to displace said second diaphragm, means for connecting the first diaphragm to said pressurized zone, and switch means operable by movement of the transmitter in response to movement of the first diaphragm to supply pressure to said pressurized zone to said predetermined level when it drops below said level. The transmitter comprises a rigid rod supported at its ends for limited axial movement in response to movement of the diaphragms at the ends and there is a crossbar fixed to said rod with its opposite ends adjacent the switch means so that movement of the bar effects actuation of the switches which, in turn, opens or closes an air valve. The pressure-responsive diaphragm at the one end comprises a polymide membrane clamped within a chamber between a rib at one side of the chamber and a ring and disk at the other side of the chamber. One side of the diaphragm is in communication with the pressurized zone and the other side bears against the disk which, in turn, has engagement with a part supported between it and the transmitter rod. The ring and disk are adapted to be changed dimensionally to obtain low and high pressure ranges.

The temperature-responsive diaphragm at the other end comprises a polymide membrane clamped between a recessed disk and a ring at the other. Recessing the disk constitutes a plenum chamber and is in communication with the sensing means comprising a capillary tube, one end of which is connected to the plenum chamber, and the other end of which is connected to a sealed bulb containing an expandable fluid. Nitrogen is used in both the pressurized zone and in the bulb.

The invention will now be described in greater detail with reference to the accompanying drawings, wherein.

In my patented Density Control Monitor, gaseous SF6 was used in the thermal assembly, that is, in the pressurized chamber and bulb. Relatively low pressure operation was visualized of up to 30 pounds per square inch. In order to provide for both low pressure and high pressure operation, nitrogen is used in place of gaseous SF6 since gaseous SF6, at a pressure of 220 pounds per square inch and a temperature of 50° F., will condense and it is desirable to be able to operate at as much as 280 pounds per square inch. Since nitrogen has a smaller gas constant than gaseous SF6, the diaphragm areas used must be larger for nitrogen than for SF6. Thus, in the low pressure device, a ratio of 1/1.95 for 30 pounds and 1/3.5 for 220 pounds per square inch is used. The larger diaphragms are also advantageous in that they alleviate enclosure distortions at the higher pressure. For very low pressures under 30 psi, the temperature and diaphragm are made larger. As will appear hereinafter, one of the diaphragms is made of Kapton and the other of stainless steel. However, it is within the scope of the invention to use any equivalent material.

Figure 1:
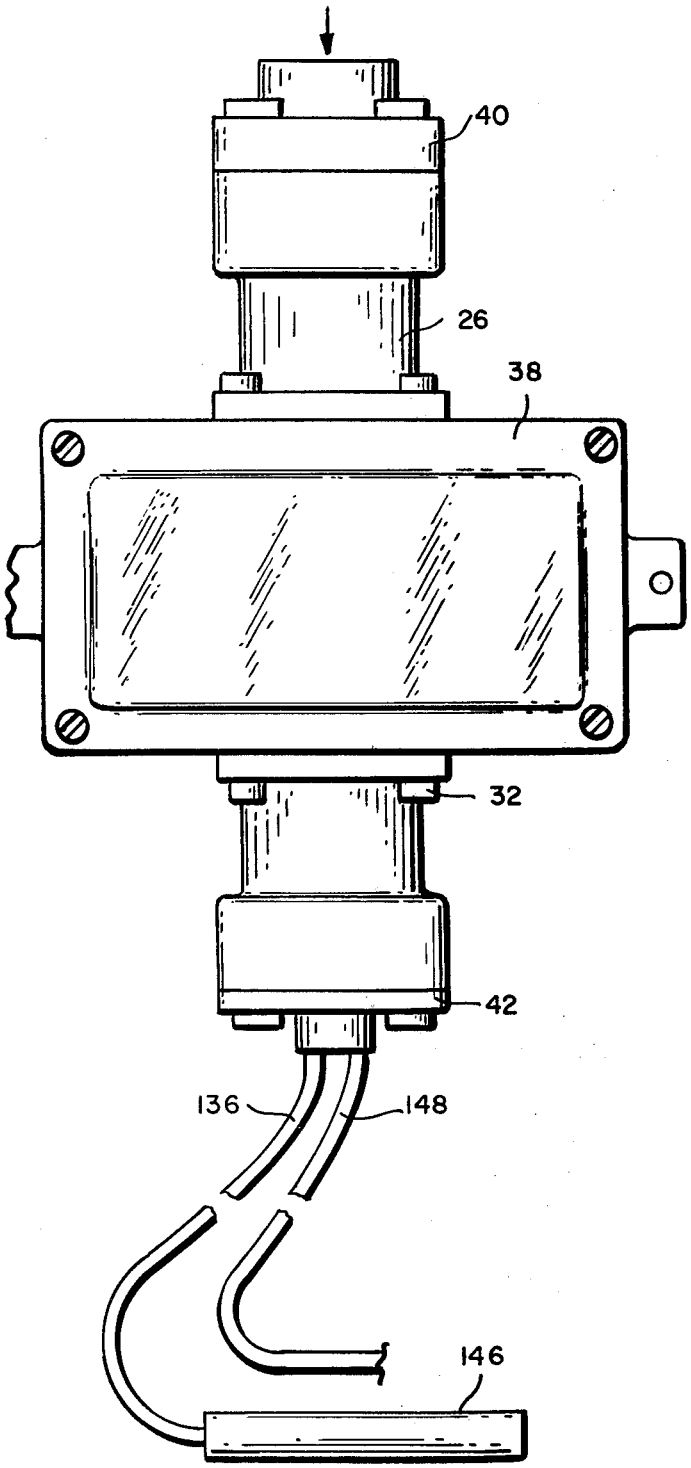
FIG. 1 is a front elevation of the control device.
Figure 2:
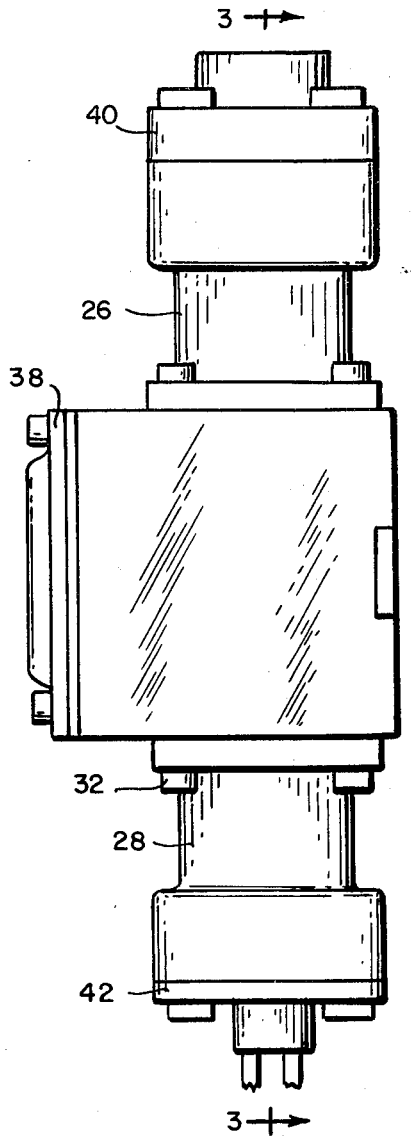
FIG. 2 is a side elevation as seen from the right side of FIG. 1.
Figure 3:
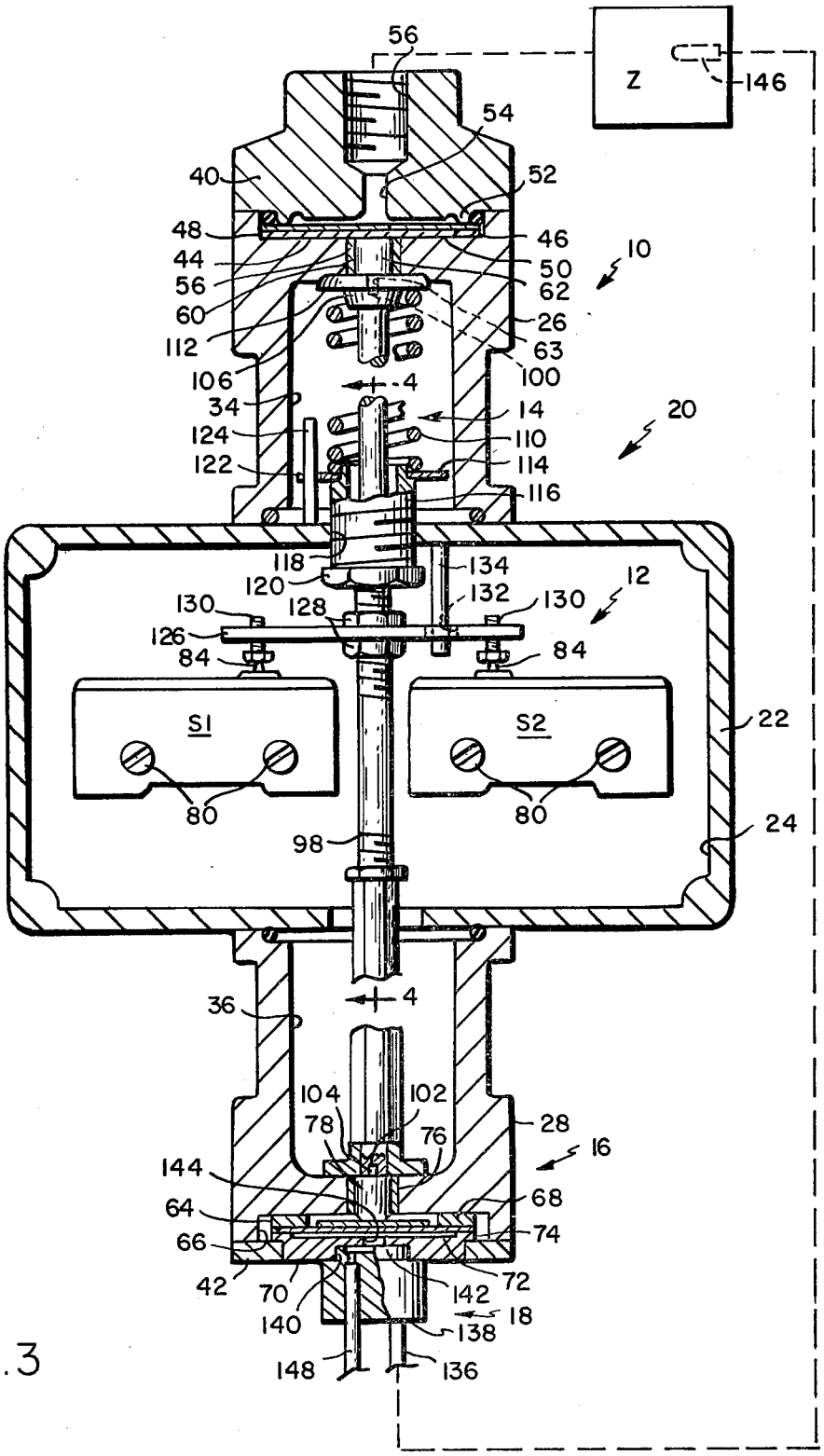
FIG. 3 is a vertical section taken on the line 3—3 of FIG. 2 with parts shown in elevation.

Referring to the drawings, FIGS. 1 to 3, the temperature compensated pressure control device as herein illustrated comprises a first diaphragm assembly 10 (top), switch means 12 operable to supply pressure to a pressurized zone, transmitter means 14 operable by the first diaphragm assembly to effect operation of the switch means, and a second diaphragm assembly 16 (bottom) for predisposing the first diaphragm assembly to compensate for temperature changes in the pressurized zone, the latter including sensing means 18 responsive to changes in temperature in the pressurized zone. The aforesaid components are assembled and supported in operative relation to each other within an enclosure 20 comprising a rigid box 22 defining a chamber 24, said box being substantially rectangular in vertical and horizontal section, and rigid cylinders 26 and 28 fastened by bolts 30 and 32 to the top and bottom walls of the box and defining, respectively, chambers 34 and 36. The box 22 and cylinders 26 and 28 are castings. The front of the box is provided with a removable cover plate 38 and the ends of the cylinders are provided with removable caps 40 and 42, respectively.

Figure 6:
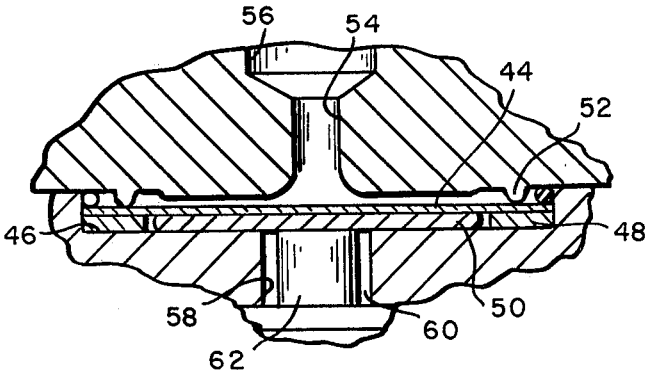
FIG. 6 is a fragmentary section to larger scale of the pressure-displaceable diaphragm assembly.

The diaphragm assembly 10 (top) comprises, as shown in FIGS. 3 and 6, a flat circular membrane element 44 of approximately 0.0001 inch thickness of a polymide film manufactured by the du Pont Company under the trademark "Kapton" supported within a chamber 46 recessed into the upper end of the cylinder 26 against an annular ring 48 and circular disk 50 situated with the annular ring at the one side and an annular rib 52 on the cap 40 which defines the other side of the chamber. The cap 40 contains a port 54 in communication at one end with the chamber 46 and the diaphragm therein and at its other end with a threaded opening 56 to which a conductor may be connected to connect the device to the pressurized zone. The cylinder 26 contains an opening 58 from the chamber 46 into the chamber 34 within which there is mounted a sleeve 60 and a cylindrical part 62.

Figure 7:
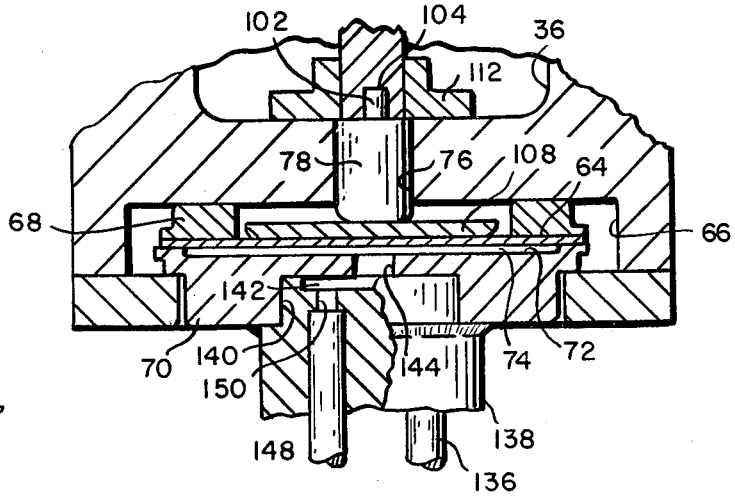
FIG. 7 is a fragmentary section to larger scale of the temperature-displaceable diaphragm assembly.

The diaphragm assembly 16 (bottom), as shown in FIGS. 3 and 7, comprises a flat, circular, stainless steel disk 64 of 0.0015 inches thickness mounted within a recess 66 at the lower end of the cylinder 28 between a ring 68 and a coupling element 70, the latter containing a circular recess 72 which defines one side of a chamber 74 between the disk 70 and the diaphragm. The cylinder 28 contains an opening 76, one end of which is in communication with the recess 66 and the other end of which is in communication with the chamber 36 within which there is supported a cylindrical part 78.

Figure 4:
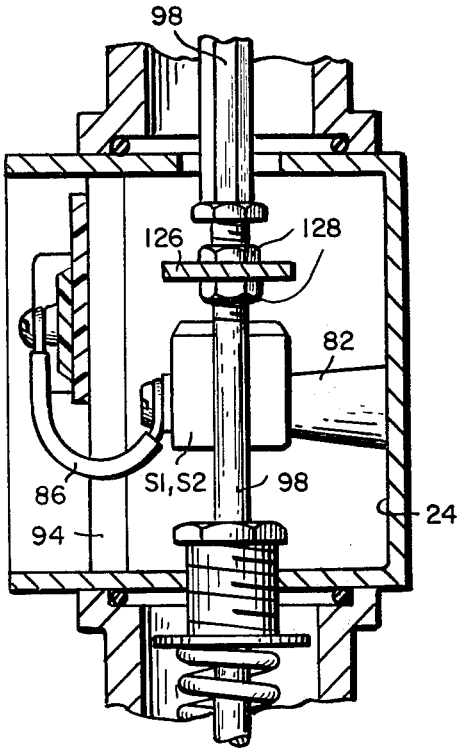
FIG. 4 is a fragmentary section taken on the line 4—4 of FIG. 3.
Figure 5:
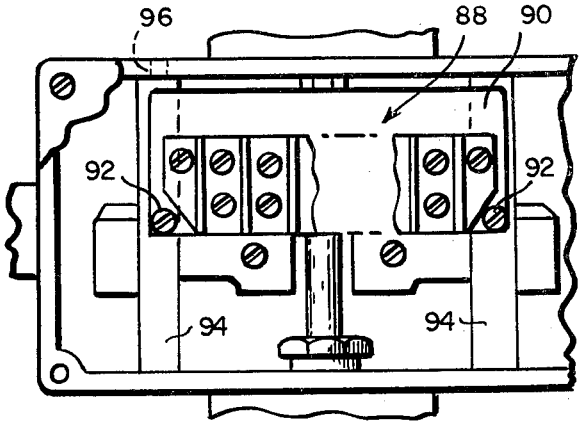
FIG. 5 is a fragmentary elevation as seen from the left side of FIG. 4.

The switch means 12 comprises two switches S1 and S2, FIG. 3, fastened by means of screw bolts 80 to posts 82 extending horizontally from the rear wall of the box 22, as shown in FIG. 4. Each switch is provided with an actuating pin 84 and is connected by conductor wires 86 to a bank of terminals 88, FIG. 5, mounted on a panel 90 which is fastened by screw bolts 92 to a supporting frame comprised of spaced, parallel, vertically disposed posts 94—94 fixed at their upper and lower ends between the top and bottom walls of the box by means of screws 96. Actuation of the switch means through suitable circuitry, of which the bank of terminals 88 is a part, operates to open a valve not shown which may be of any commercially available kind to supply pressure to the pressurized zone serviced by this equipment.

The switch means is actuated by the first diaphragm assembly in response to a change of pressure within the pressurized zone by way of the transmitter means 14 and the latter comprises, as shown in FIG. 3, a rigid rod 98 supported within the structure with one end within the chamber 14, the other end in the chamber 36 and the portion intermediate the ends within the chamber 24. The end within the chamber 34 is supported in axial alignment with the part 62 by a pin 100 extending from the part 62 into an axial hole 63 in the rod 98. The end within the chamber 36 is supported by a pin 102 extending from the part 78 into an axial hole 104 in the rod 98. The lower end of the part 78 rests on a flat disk 108 which, in turn, rests on the diaphragm 64.

A coiled spring 110 mounted within the chamber 34 about that portion of the rod 98 situated within the chamber between a collar 106 soldered to the rod 98 which has, for this purpose, an annular shoulder 112 thereon and a collar 114 fixed to the end of a threaded sleeve 116 threaded into an opening 118 in the top wall of the box 22. The sleeve 116 has on it a polygonal-shaped head 120 by means of which it may be rotated to change the compression in the spring 110 and, hence, the resistance of the diaphragm to displacement. To prevent rotation of the collar 114 during adjustment of the compression of the spring, the collar is provided with a slot 122 for receiving a pin 124 which is fixed at one end to the top wall of the box and extends through the slot.

A crossbar 126, FIG. 3, is mounted on the actuator rod 98 within the chamber 24 above the switches S1,S2 by means of nuts 128 threaded onto the actuator rod above and below the crossbar. At the ends of the crossbar, there are screws 130—130 arranged to engage the switch pins 84—84 and disengage the same. To prevent rotation of the crossbar 126 relative to the actuator rod, there is an opening 132 in the crossbar within which one end of a pin 134 is received. The other end of the pin 34 is fixed to the top wall of the box.

The sensing means 18, FIGS. 3 and 7, comprise a capillary tube 136 connected at one end to an adapter plug 138 which is welded into a recess 140 at the lower side of coupling element 70. The coupling element 70 in conjunction with the bottom of the recess from which it is spaced define a chamber 142. The chamber 142 is connected by a port 144 to the chamber 74. The opposite end of the capillary tube 136 is connected to a sealed bulb 146, FIG. 1, which contains an expandable fluid, specifically nitrogen. As contrasted to SF6 which was used in the device shown in my U.S. Pat. No. 4,057,699, nitrogen is utilized because it can be used at a lower temperature without liquifying. When filling, as long as it is pressurized to the corresponding ambient temperature on the SF6 gas curve (pressure versus temperature), it, that is, the nitrogen, will expand at the same rate as the SF6. The capillary tube 136 is made long enough so that the bulb can be disposed in the pressurized zone without necessarily mounting the control device in the immediate vicinity of a pressurized zone. A tube 148 is connected at one end to the adapter plug 138 and has communication with the chamber 142 by way of a port 150. The other end of the tube 148 is closed and the tube 148 thus constitutes an expansion element for the expandable fluid.

A rise in temperature within the pressurized zone will cause the fluid to expand in the bulb 146 so that the expanding fluid enters the chamber 142 and from thence passes through the opening 144 into the chamber 74 so as to act directly on the diaphragm 64. In my U.S. Pat. No. 4,057,699, SF6 gas is used in the chamber and the bulb. However, below 50° F. and a pressure of as much as 220 pounds, the SF6 liquifies and, hence, cannot be used. Because nitrogen can be used at this much lower pressure and temperature, the device made as herein described provided with nitrogen for the activating gas enables use of the device for both low and high pressure ranges. Because the nitrogen has a smaller gas constant, a larger area diaphragm is required and, as pointed out heretofore, the larger area diaphragm is beneficial because it alleviates distortion of the enclosure due to the higher operating pressures. Upward displacement of the diaphragm 64 raises the actuator rod 98 so as to lift the heads of the screws 130—130 away from the switch pins 84—84. Conversely, a drop in temperature within the pressurized zone will cause the fluid to contract in the bulb and, hence, leave the chamber 142, thereby allowing the actuator rod to descend so as to lower the heads of the screws 130—130 toward the switch pins 84—84.

In operation, if a leak develops in the pressurized zone, the spring 110 will force the actuator rod 98 upwardly, as seen in FIG. 3, until the collar 106 seats against the top of the recess 34. The upward movement of the rod 98, as shown in FIG. 3, disengages the screws 130—130 from the switch actuating pins 84, thus allowing a circuit to be completed to open an air valve for the purpose of restoring the pressure in the pressurized zone to its predetermined minimum. When the pressure reaches the predetermined minimum, the diaphragm 44 pushes the rod 98 downwardly in opposition to the spring 110 so as to engage the screws with the switch pins and thus break the circuit, which, in turn, opens the air valve.

Conversely, when the pressure in the pressurized zone builds up to the predetermined desired pressure, it will displace the diaphragm, overcome the pressure of the spring and move the rod 98 downwardly, thus engaging the switches which actuate the circuit to close the air valve.

To compensate for a pressure in excess of normal pressure at the predetermined pressure of the system, diaphragm 64 which is displaced by a rise in temperature within the pressurized zone pre-positions the cross-bar 126 by moving the actuator rod 98 upwardly so as to separate the screws from the switch pins by an amount to compensate for the higher temperature.

The Kapton diaphragm as mentioned for use as the top diaphragm is a polymide film which is exceptionally strong, heat-resistant and has excellent mechanical and electrical properties. It can be used at a temperature of −269° C. to 400° C., is flame-resistant, does not melt, resists organic solvents and has a very high resistance to high energy radiation. As used herein, it is coated on one or both sides with Teflon FEP fluorocarbon resin to provide heat-sealability, to provide a moisture barrier, and to enhance chemical resistance. Although Kapton is recommended for the one diaphragm and stainless steel for the other, it is within the scope of the invention to use other material which will provide equivalent properties.

The structure as described comprises a minimum number of component parts, minimum manufacturing operations and minimum adjustments while, at the same time, affording a high degree of sensitivity.

It should be understood that the present disclosure is for the purpose of illustration only and includes all modifications or improvements which fall within the scope of the appended claims.

I claim:

1. A temperature compensated pressure control device comprising a first diaphragm, means defining a conductor connecting one side of said first diaphragm to a pressurized zone, said first diaphragm comprising a membrane clamped within a chamber between a rib at one side of the chamber and a ring and disk at the other side of the chamber, switch means, transmitter means for transmitting movement of the first diaphragm to actuate the switch means comprising a rod and a post supported at the center of the disk in axial alignment with the rod for limited movement between the disk and the end of the rod, means operable by actuation of the switch means to establish a predetermined pressure in said pressurized zone, and means for predisposing the transmitter to compensate for a change in temperature from the normal predetermined temperature in said pressurized zone comprising a second diaphragm arranged to effect movement of the transmitter and sensing means responsive to a change in temperature in the pressurized zone for effecting compensating movement of the diaphragm.

2. A temperature compensated pressure control device according to claim 1 wherein the ring and disk are adapted to be interchangeable for a ring and disk of different dimension to obtain low and high pressure ranges.

3. A temperature compensated pressure control device according to claim 1 wherein a first collar is fixed to the upper end of the rod, a second collar is mounted about the rod in axial spaced relation to the first collar through which the rod passes freely and a coiled spring is mounted in compression about the rod between said collars.

4. A temperature compensated pressure control device according to claim 3 wherein there is means for adjusting the position of the second collar relative to the first collar to change the compression of the coiled spring.

5. A temperature compensated pressure control device according to claim 1 wherein said second diaphragm is welded between a ring at one side and a rigid plate at the other side, said plate containing a centrally located recess and port in communication with said other side of the diaphragm and there is means welding the one end of a capillary tube to said rigid plate in communication with said centrally located recess and port such that the diaphragm and sensing means can be removably mounted to the control device as a unit.

6. A temperature compensated pressure control device comprising a transmitter rod supported at its ends for limited axial movement, a bar fixed to the transmitter rod with its ends extending radially from the axis thereof, switches mounted adjacent the ends of the bar in positions to be actuated thereby upon axial movement of the transmitter rod, said bar containing an opening spaced from the axis of the rod and wherein a pin fixed at one end with its other end extending through the opening provides for preventing rotation of the bar about the rod, switch means mounted adjacent the ends of the bar and positioned to be actuated thereby upon axial movement of the transmitter rod, a first pressure-operable diaphragm at one end of the transmitter rod, means for transmitting planar movement of the diaphragm in response to an increase in pressure to rectilinear movement of the transmitter rod to deactivate the switch means, a second diaphragm at the other end of the transmitter rod, spring biased means holding one of the diaphragms in a predetermined position for a predetermined pressure and temperature, means for transmitting planar movement of the second diaphragm in response to a rise in temperature to rectilinear movement of the transmitter rod in a direction to move the ends of the bar away from the switch means, and sensing means connected to the second diaphragm containing an expandable fluid operable by expansion to displace the second diaphragm in opposition to said spring-biased means.

* * * * *